US006705220B2

(12) United States Patent
Boucher

(10) Patent No.: US 6,705,220 B2
(45) Date of Patent: Mar. 16, 2004

(54) DEVICE FOR GUIDING A TRAVELLING WEB

(75) Inventor: Ronald Henry Boucher, Goffstown, NH (US)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/887,291

(22) Filed: Jun. 22, 2001

(65) Prior Publication Data

US 2002/0195009 A1 Dec. 26, 2002

(51) Int. Cl.[7] ..... B41F 13/06

(52) U.S. Cl. ..... 101/228; 101/225; 101/227; 101/232

(58) Field of Search ..... 101/222, 223, 101/224, 225, 227, 228, 232, 219, 220

(56) References Cited

U.S. PATENT DOCUMENTS 1,169,786 A * 2/1916 Firm ..... 101/220
2,797,091 A * 6/1957 Fife ..... 226/22
3,595,459 A * 7/1971 Colombo ..... 226/21
4,567,824 A * 2/1986 Dahlgren et al. ..... 101/183
5,048,810 A * 9/1991 Palmatier et al. ..... 101/228
5,108,022 A * 4/1992 Birkmair et al. ..... 226/15
5,199,351 A * 4/1993 Shibuya et al. ..... 101/228
5,357,859 A * 10/1994 Eckert ..... 101/225
5,520,317 A * 5/1996 Eckert et al. ..... 226/196.1
6,321,650 B1 * 11/2001 Ogawa et al. ..... 101/219
6,325,266 B1 * 12/2001 Suzuki ..... 101/223

* cited by examiner

*Primary Examiner*—Daniel J. Colilla
*Assistant Examiner*—Jill E Culler
(74) *Attorney, Agent, or Firm*—Davidson, Davidson & Kappel, LLC

(57) ABSTRACT

A device for guiding a travelling web comprises a first movable angle bar and a second movable angle bar located in respective positions in a first operative mode to guide the travelling web from an entering direction to an exiting direction and to define a first print-to-cut registration setting. In a second operative mode the exiting direction of the travelling web is changed and the print-to-cut register is maintained, whereas in a third operative mode the print-to-cut register is changed and the exiting direction is maintained.

31 Claims, 11 Drawing Sheets

DEVICE FOR GUIDING A TRAVELLING WEB

BACKGROUND OF THE INVENTION

The present invention relates generally to printing presses and more particularly to a device and a method for guiding a travelling web.

In a web-fed printing press, e.g. an offset lithographic printing press, one or more material webs, e.g. paper webs, are printed by respective print couples of printing units with different colors and are then fed to a folding apparatus for creating folded signatures. A folding apparatus typically comprises a superstructure in which a plurality of angle bars or turning bars are located and guide the paper webs from the printing units to the former boards of the folding apparatus. The angle bars can be air loaded with compressed air, which exits the angle bars through air nozzles, located in the surface of the angle bars and can also be coated with a chromium surface. Both the pressurized air and the coated surface reduce the friction of the angle bar surface and therefore marking of the freshly printed paper webs. For better access, the angle bars can be cantilevered in the superstructure of the folding apparatus.

The angle bars are used for offsetting and turning a guided travelling web or longitudinally cut ribbons of the web. A delivered portion of the web can be laterally offset with respect to an arriving portion of the web by the use of two parallel angle bars. The web can therefore be shifted for example from one side of the machine to the other side of the machine. The delivered portion of the web can also be turned with respect to the arriving portion of the web by the use of two parallel angle bars and an additional deflection roller, which is located between the two angle bars in direction of the web path.

The afore-mentioned angle bar arrangements are also used for bringing together and superposing printed paper webs before the webs are fed to a common former board of the folding apparatus.

U.S. Pat. No. 5,108,022 discloses a universal web turning system, particularly for printed webs derived from a rotary web-type printing machine. The turning system comprises a first and a second turning bar and a first and a second deflection roller which are retained in an essentially rectangular frame, with the position of the turning bars adjustable along the sides of the frame and the position of the deflection rollers being longitudinally adjustable along the sides of the frame as well as height-adjustable perpendicular to the plane of the web travelling between the respective turning bars and deflection rollers. The turning system allows for turning, offsetting or turning and offsetting a web of material especially a printed web.

For adjusting the print-to-cut register known devices are provided with an additional movable compensator roller, which by its movement changes the length of the paper path, and therefore also the print-to-cut register. U.S. Pat. No. 5,108,022 does not disclose how to adjust the print-to-cut register.

The device of the '022 U.S. patent has a disadvantage in that at least three guiding elements, the two turning bars and at least one additional deflection roller, are needed to provide the turning system with the necessary guiding characteristics.

BRIEF SUMMARY OF THE INVENTION

An object of the present invention is to provide for a reliable and efficient device for guiding a travelling web, which comprises few movable components for achieving the necessary guiding characteristics.

The present invention provides a device for guiding a travelling web comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting; and the first movable angle bar being located in a position P5 and the second movable angle bar being located in a position P6 in a third operative mode to guide the travelling web from the entering direction D1 to the exiting direction D2, the third operative mode having a second print-to-cut registration setting.

The terms P1 to P13 and D1 to D4 in this application are used herein solely to distinguish the positions and direction from one another, and are not meant to have any specific meaning. The operative modes may also be called operative conditions.

The present invention permits guiding of a travelling web, particularly shifting the exiting direction of the travelling web and permits adjusting the print-to-cut registration setting with only two movable angle bars. It is an advantage of the present invention that the number of movable components is reduced to only two movable angle bars without the need of further compensator rollers and that therefore a cost and maintenance reduction can be achieved.

It is possible to change, i.e. to move or locate the respective angle bars, from the first operative mode to the second or the third operative mode or to change from the second operative mode to the third operative mode. Also returning to the first operative mode is possible from the second or the third operative mode is possible.

In a further embodiment of the invention the device comprises at least one first movable device being operative for moving the first movable angle bar and at least one second movable device being operative for moving the second movable angle bar.

Preferably, at least one of the first and second movable angle bars is pivotable.

In a preferred embodiment of the invention at least one of the first and second movable devices is a sliding carriage and at least one of the first and second movable angle bars is pivotably mounted on the respective movable device. The sliding carriage provides a linear movement, preferably substantially perpendicular to the direction of the arriving portion of the travelling web, and by mounting the angle bars pivotally on the respective sliding carriages also a rotational movement can be provided and can be superposed with the linear movement of the sliding carriage.

It is further possible and in certain cases even advantageous to support at least one of the first and second movable angle bars by means of pistons, which are slidably supported by the sliding carriage, i.e. for example by a base body of the sliding carriage.

It is also possible that at least one of the first and second movable angle bars is pivotably mounted with both ends to one of the respective movable devices.

In accordance with another feature of the invention, the device further comprises at least one further guiding element, e.g. a third bar or a first deflection roller, located between the first angle bar and the second angle bar on the path of the travelling web, the further guiding element guiding the web from the first angle bar to the second angle bar thereby turning the web. The axis of the further guiding element, e.g. of the third bar can be located substantially parallel to the direction of the arriving portion of the guided web. Further, it is possible that the further guiding element of the device is movable.

A device according to the invention can also comprise two further guiding elements, e.g. a third and a fourth bar located between the first angle bar and the second angle bar on the path of a travelling web, the third and the fourth bar located one above the other, in order to guide the travelling web from a lower angle bar unit to an upper angle bar unit. This advantageously allows for feeding multiple-color pages to any part of a newspaper in a press with limited color capability.

All the movements of the angle bars, bars or deflection rollers can be performed manually or automatically.

In accordance with another feature of the invention, the device further comprises a control device for controlling an automatic movement of at least one of the first and second movable angle bars in e.g. at least one of the second and third operative modes. The control device allows for an automatic change or location of the movable angle bars from one position to another position e.g. by activating or driving the at least one first and second movable devices being operative for moving the respective first and second movable angle bars. This advantageous embodiment also allows for a remote setting of the angle bars, e.g. when a registration adjustment is necessary because the water content of the web effected a misregistration.

In accordance with an additional feature of the invention, the control device calculates the movement of at least one of the first and second movable angle bars dependent on the entering direction D1, the exiting direction D2, the exiting direction D3 and the first print-to-cut registration setting. The calculation can be performed in the first operative mode and the calculated position changes can be used to move the first and the second angle bars to respective positions in the second operative mode.

In accordance with another feature of the invention the control device calculates the movement of at least one of the first and second movable angle bars dependent on the entering direction D1, the exiting direction D2, the first print-to-cut registration setting and the second print-to-cut registration setting. It is advantageous to calculate the position changes of the first and second movable angle bars in the first operative mode and to use the calculated position changes or calculated new positions to achieve the third operative mode by locating the movable angle bars in their respective positions, which define the third operative mode or condition.

According to another exemplary embodiment of the invention, the control device calculates the movement of at least one of the first and second movable angle bars dependent on the distance between a first reference point of the path of the travelling web located upstream of the first angle bar and a second reference point of the path of the travelling web located downstream of the second angle bar.

In a first embodiment the control device can calculate the movement of at least one of the first and second movable angle bars without changing the distance between the two reference points, so that the first print-to-cut registration setting is maintained, whereas in a second embodiment the control device can calculate the movement of at least one of the first and second movable angle bars with a defined change in the distance between the first and second reference points to change to a second print-to-cut registration setting.

In a further embodiment of the invention the device further comprises at least one driving device, for example an electric motor or a stepping motor, for the movement of the respective movable device of at least one of the movable angle bars. The at least one driving device may be controlled by the control device.

It is also possible, that the different positions, i.e. the coordinates of the positions, are stored in storing device, e.g. a harddisc, after being calculated and are loaded from the storing device into the control device for controlling the locations or movement of the different angle bars, bars or rollers.

Further, in an advantageous embodiment of the present invention, at least one of the first and second movable angle bars is air loaded, for example with pressurized air. It is also possible that at least one of the first and second movable angle bars is provided with a low friction surface, for example a chromium coated surface, which can also be polished.

In accordance with another feature of the present invention at least one of the exiting directions of the delivered portion of the travelling web or the longitudinally cut ribbons of the printed web is parallel to the entering direction of the arriving portion of the travelling web or the longitudinally cut ribbons of the printed web. By the use of additional deflection bars or deflection rollers the exiting direction of the travelling web can be changed to any desired direction and the orientation of the exiting direction can also be opposite to the entering direction of the travelling web.

According to another advantageous embodiment of the present invention the first movable angle bar is located in a position P7 and the second movable angle bar is located in a position P8 in a fourth operative mode or condition to guide the travelling web from the entering direction D1 to an exiting direction D4, the exiting direction D4 being offset with respect to the exiting direction D2, and the fourth operative mode having a third print-to-cut registration setting.

According to another embodiment of the invention, the device for guiding a travelling web comprises a first movable angle bar and a second movable angle bar, the first movable angle bar being located in a position P1 and the second movable angle bar being located in a position P2 in a first operative mode to guide the travelling web from an entering direction D1 to an exiting direction D2 and to define a first print-to-cut registration setting, the first movable angle bar being located in a position P7 and the second movable angle bar being located in a position P8 in a fourth operative mode to guide the travelling web from the entering direction D1 to an exiting direction D4, the exiting direction D4 being offset with respect to the exiting direction D2, the fourth operative mode having the third print-to-cut registration setting An embodiment of the invention comprising a fourth operative mode allows for simultaneously changing the exiting direction of the travelling web and the print-to-cut registration setting. It is possible to change from the first operative mode to the fourth operative mode or to return from the fourth operative mode to the first operative mode. The above-mentioned control device can also control the automatic movements of the angle bars in the fourth operative mode.

A further embodiment of the invention provides that the first movable angle is located in a position P9 and the second movable angle bar is located in a position P10 in a parking operative mode to park the first and second movable angle bars, e.g. for operator access. The parking position advantageously eliminates the need for removing the angle bars for better access.

In a further embodiment of the present invention the first movable angle bar is located in a position P11 and the second movable angle bar is located in a position P12 in a web up operative mode to thread a web through the device.

The device according to the present invention also allows for moving the two movable angle bars into the web-up position, for forwarding a web through the open space between the angle bars and to relocate the two angle bars into their respective guiding positions without locating the two angle bars at an angle to the travelling direction of the web. The web is thereby guided from the entering direction to the exiting direction without a lateral web shift. The web therefore runs straight through the angle bar unit without using the angle bars for offsetting the exiting portion of the web with respect to the entering portion of the web, which allows totally automated web-up performance.

It is also possible to combine the parking operative mode and the web-up operative mode in one operative mode of the inventive device.

The first movable angle bar can also be located in a position P13 in a fifth operative mode to accommodate the entering direction D1 of the travelling web in accordance with another embodiment of the present invention. This movement, which can also be controlled by above-mentioned control device, allows e.g. the correct positioning of the first angle bar when a lateral offset of the printed paper web has been performed particularly in a two or more web width printing press.

The present invention also provides a method for guiding a travelling web comprising the following steps:

locating a first movable angle bar in a position P1, locating a second movable angle bar in a position P2, guiding the travelling web from an entering direction D1 to an exiting direction D2 and defining a first print-to-cut registration setting;

moving the first movable angle bar into a position P3, moving the second movable angle bar into a position P4, thereby maintaining the first print-to-cut registration setting, and guiding the travelling web from the entering direction D1 to an exiting direction D3, the exiting direction D3 being offset with respect to the exiting direction D2; and moving the first movable angle bar into a position P5, moving the second movable angle bar into a position P6, thereby maintaining the exiting direction D2 and changing to a second print-to-cut registration setting.

The method according to the invention allows for a simple change of the exiting direction of the travelling web or a simple change of the print-to-cut registration setting only by moving the first and second movable angle bars.

The present invention further provides a method for guiding a travelling web, comprising the following steps:

locating a first movable angle bar in a position P1, locating a second movable angle bar in a position P2, guiding the travelling web from an entering direction D1 to an exiting direction D2 and defining a first print-to-cut registration setting;

moving the first movable angle bar into a position P7, moving the second movable angle bar into a position P8, thereby changing to a third print-to-cut registration setting, and guiding the travelling web from the entering direction D1 to an exiting direction D4, the exiting direction D4 being offset to the exiting direction D2.

This method according to the invention provides a simple and simultaneous change of the exiting direction of the travelling web and of the print-to-cut registration setting.

BRIEF DESCRIPTION OF THE DRAWINGS

Preferred embodiments of the present invention are described below by reference to the following drawings, in which.

DETAILED DESCRIPTION OF THE PREFERRED EMBODIMENTS

Figure 1:
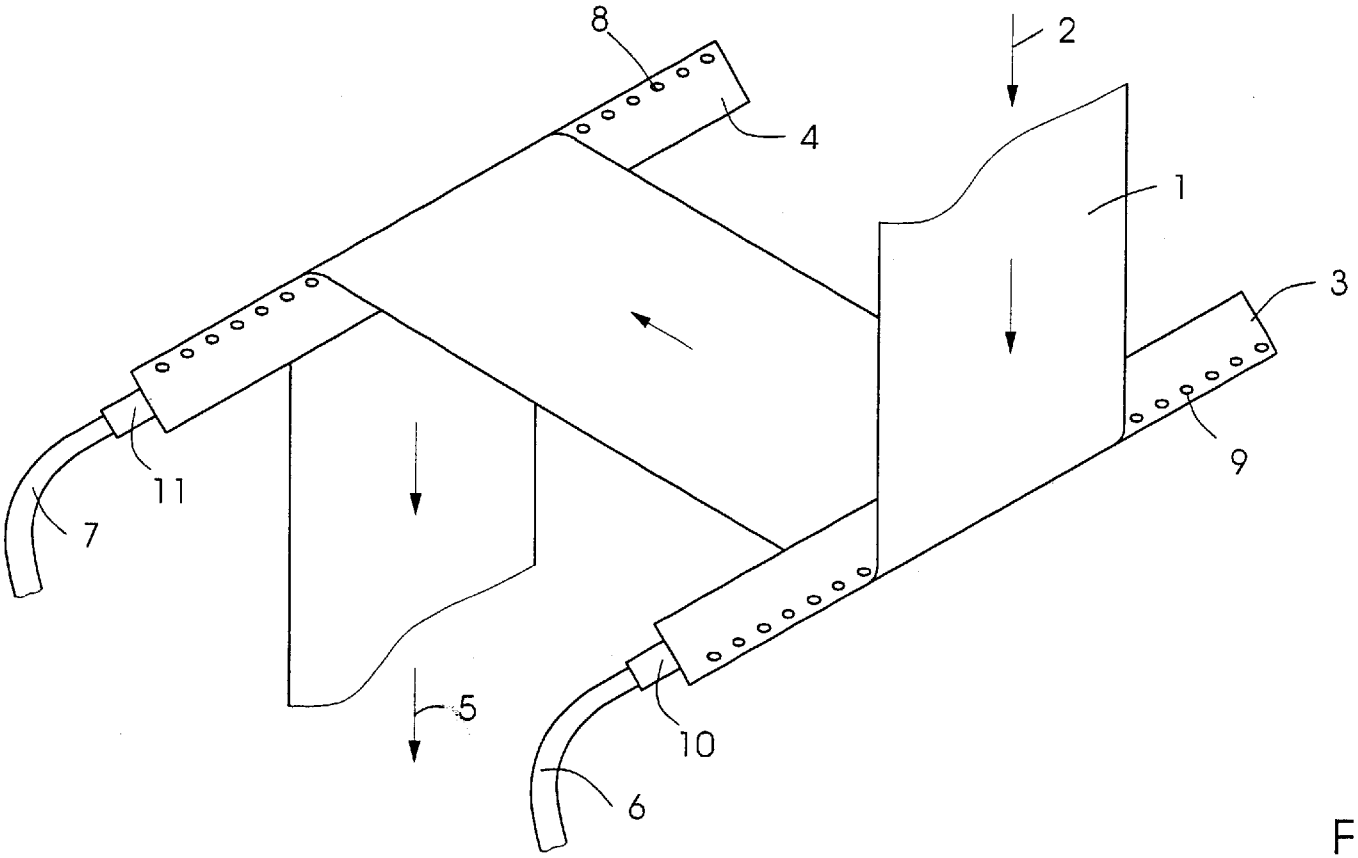
FIG. 1 shows a top view of the device for guiding a travelling web in the first operative mode according to the present invention.

FIG. 1 shows a web of material 1, for example a printed paper web, which is fed through a device for guiding a travelling web. The web 1 arrives from an entering direction D1 indicated by arrow 2, is wrapped around a first movable angle bar 3, is directed to and fed around a second movable angle bar 4 and leaves the device in an exiting direction D2 indicated by arrow 5. The first and the second movable angle bar 3, 4 are supplied with pressurized air via lines 6, 7 which can be pipelines, tubes or hoses and the respective outer surface of the two angle bars 3, 4 is provided with a respective plurality of holes or air nozzles 8, 9 through which the pressurized air exits the movable angle bars 3, 4 and creates an air cushion beneath the guided web for reduced friction guidance of the travelling web 1. Additionally, the outer surface of the two angle bars 3, 4 can be coated with a reduced friction surface, for example a chromium surface, which can also be polished.

The pressurized air lines 6, 7 are connected to the movable angle bars 3, 4 through connections 10, 11.

According to the invention, the two angle bars 3, 4 are movable in order to change the exiting direction D2 for the print-to-cut registration setting and specific embodiments of preferred movable devices are shown in FIG. 5, FIG. 6, FIG. 7 and FIG. 10.

Figure 2A:
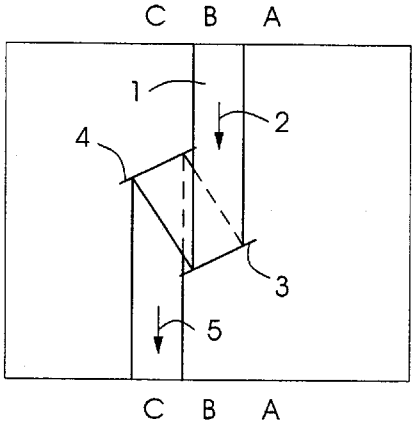
FIGS. 2*a*, 2*b*, 2*c*, 2*d*, 2*e*, 2*f* and 2*g* show a schematic sequence of different locations of the first and the second movable angle bars in the second operative mode according to the present invention.
Figure 2B:
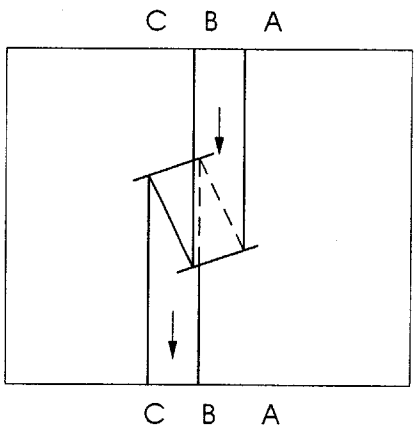
Figure 2C:
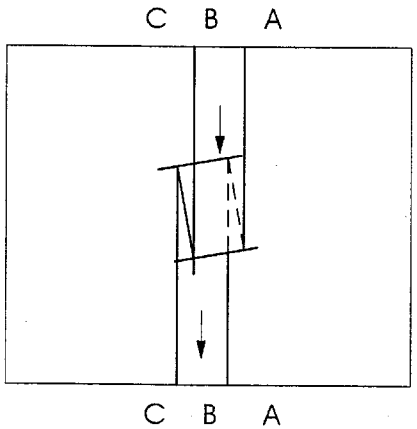
Figure 2D:
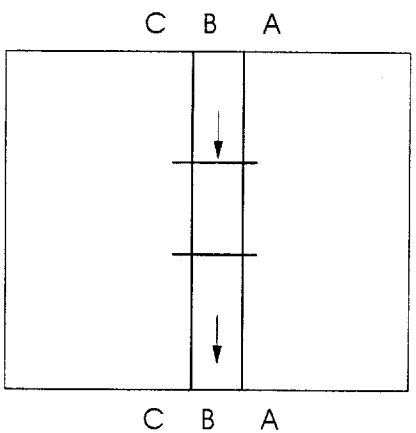
Figure 2F:
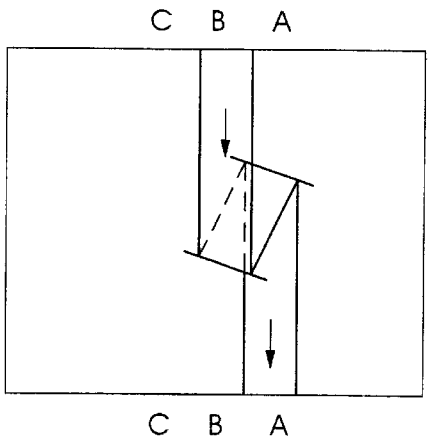
Figure 2E:
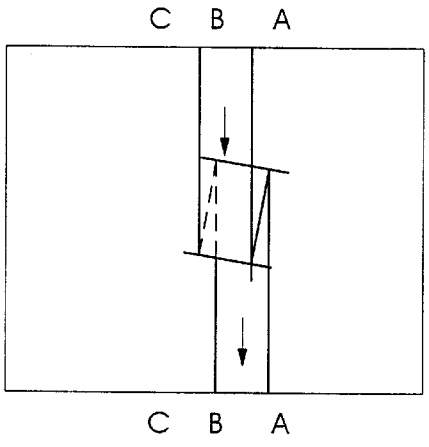
Figure 2G:
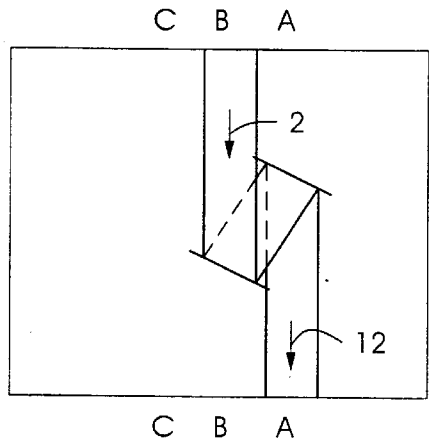

FIGS. 2*a*–2*g* show a progressive sequence of different locations of the two angle bars 3, 4 that is performed for changing the exiting direction D2 indicated by arrow 5 in FIG. 2*a* to an exiting direction D3 indicated by arrow 12 in FIG. 2*g*. The different locations of the angle bars 3, 4 define a movement of the angle bars 3, 4 when being moved from their positions in one operative mode to their positions in another operative mode.

In FIG. 2*a* the first angle bar 3 is shown in a Position P1 und the second angle bar 4 is shown in a position P2, whereas in FIG. 2*g* the first angle bar 3 is shown in a Position P3 und the second angle bar 4 is shown in a position P4.

FIGS. 2*a* through 2*g* also show that the entering direction D1 indicated by arrow 2 does not change, but stays in a middle position indicated by B. A, B and C correspond to three side-by-side positions of the web 1 which are defined by the characteristics of the upstream components of a printing machine, for example other devices for guiding the travelling web 1, a chill stand unit, a dryer, the print units or by downstream components, for example the former boards of a folder.

The movement of the first movable angle bar or the infeed angle bar 3 and the movement of the second movable angle bar or the outfeed angle bar 4 result in a shifting of the exiting portion of the web 1 from position C as shown in FIG. 2*a* to a position A as shown in FIG. 2*g*. The registration setting, which is indicated by the longitudinal position of arrow 5 in direction of the paper web does not change in the shown movement sequence and is therefore maintained.

It can be seen from FIGS. 2*a*–2*g* that the angle bar 3 makes a rotational movement whereas the angle bar 4 makes a movement, which is a superposition of rotational and curved movements. The curved movement, which can also be a linear movement, of angle bar 4 effects the web side shift from position C to position A and the constancy of the web path length whereas the additional rotational movements of angle bars 3, 4 effect the parallel alignment of the two angle bars.

As can also be seen from FIGS. 2*a*–2*g* the distance between the tip of arrow 2 and the tip of arrow 5 which can be used as referenced points upstream and downstream of the device for guiding the travelling web does not change in the movement sequence, so that the registration setting is kept constant.

Figure 3B:
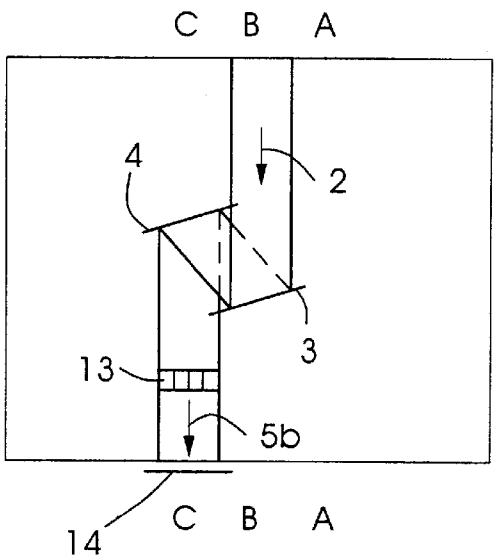
FIGS. 3*a, b* show a schematic sequence of different locations of the movable angle bars in the third operative mode according to the present invention.
Figure 3A:
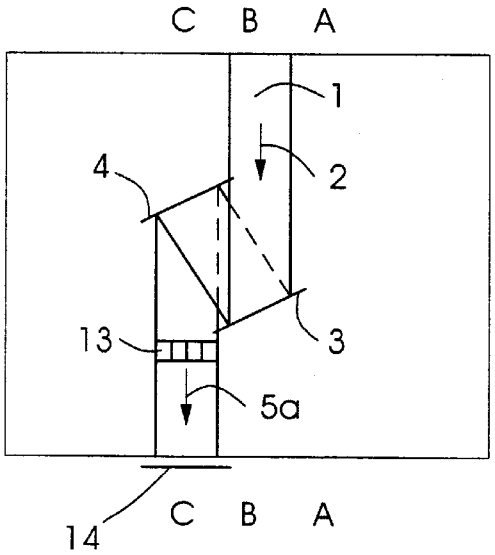

FIGS. 3*a* and 3*b* show another sequence of movements of the two angle bars 3, 4 that is performed in order to change the print-to-cut registration setting of the guided travelling web. In both figures the web 1 enters the device from an entering direction D1 indicated by arrow 2, which corresponds to a position B and the web exits the device with an exiting direction D2 indicated by arrow 5*a* in FIG. 3*a* and indicated by arrow 5*b* in FIG. 3*b*. FIGS. 3*a* and 3*b* show that the movement of the two angle or turner bars 3, 4 in this case does not influence the lateral exiting direction which corresponds to the position C.

In FIG. 3*a* the first angle bar 3 is shown in a position P1 und the second angle bar 4 is shown in a position P2, whereas in FIG. 3*b* the first angle bar 3 is shown in a Position P5 und the second angle bar 4 is shown in a position P6.

As can be seen from arrows 5*a* and 5*b* which also indicate the print-to-cut registration setting, the tip of arrow 5*b* has moved with respect to the tip of arrow 5*a* in longitudinal direction of the web. It can also be seen from the two figures that the respective distance between the tip of arrow 2 to the respective tip of arrow 5*a* or 5*b* is different indicating that the web path through the device has also changed and in this case, e.g. has decreased.

This results in a change of the distance between printed pages 13 to a cross cutting knife 14 so that the print-to-cut registration setting can be varied.

As shown in FIGS. 3*a* and 3*b* the movement of the angle bars 3, 4 can be a superposition of rotational and curved or linear movements. The curved or linear movement in longitudinal direction of the web 1 effects the change in the registration setting and the rotational movement effects a proper parallel alignment of the two angle bars 3, 4. It is possible to move only one of the two angle bars or both in a curved or linear way.

Figure 4:
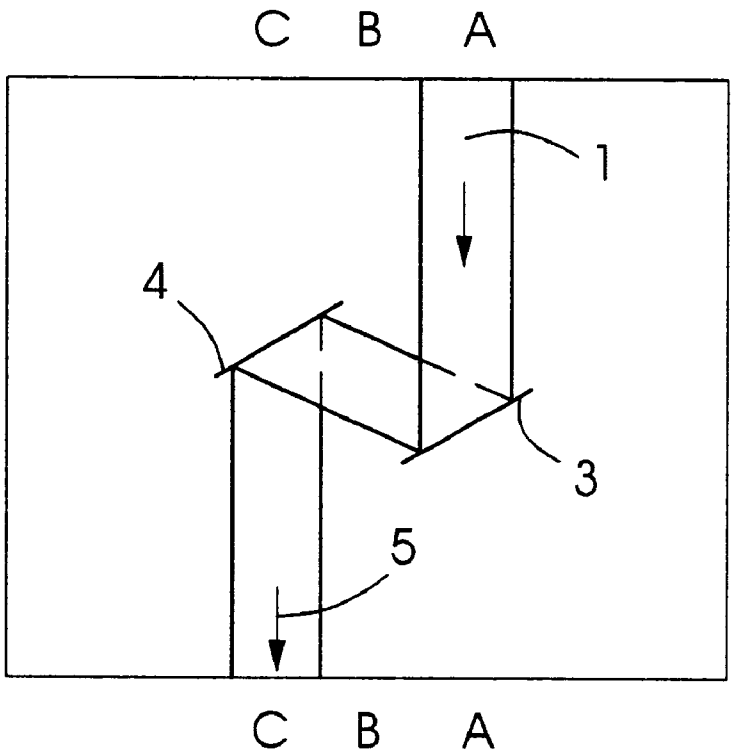
FIG. 4 shows a schematic view of a side shift of the travelling web according to the invention.

In FIG. 4 the web 1 is guided from an entering position A to an exiting position C which positions are offset more than one web width. In view of FIGS. 2*a*–2*g* and 3*a*, 3*b* this indicates that the change of the exiting direction D2 indicated by arrow 5 and the change of the print-to-cut registration setting also indicated by arrow 5 is not limited to one web width offset but can also be performed with at least a two web width offset.

Figure 5:
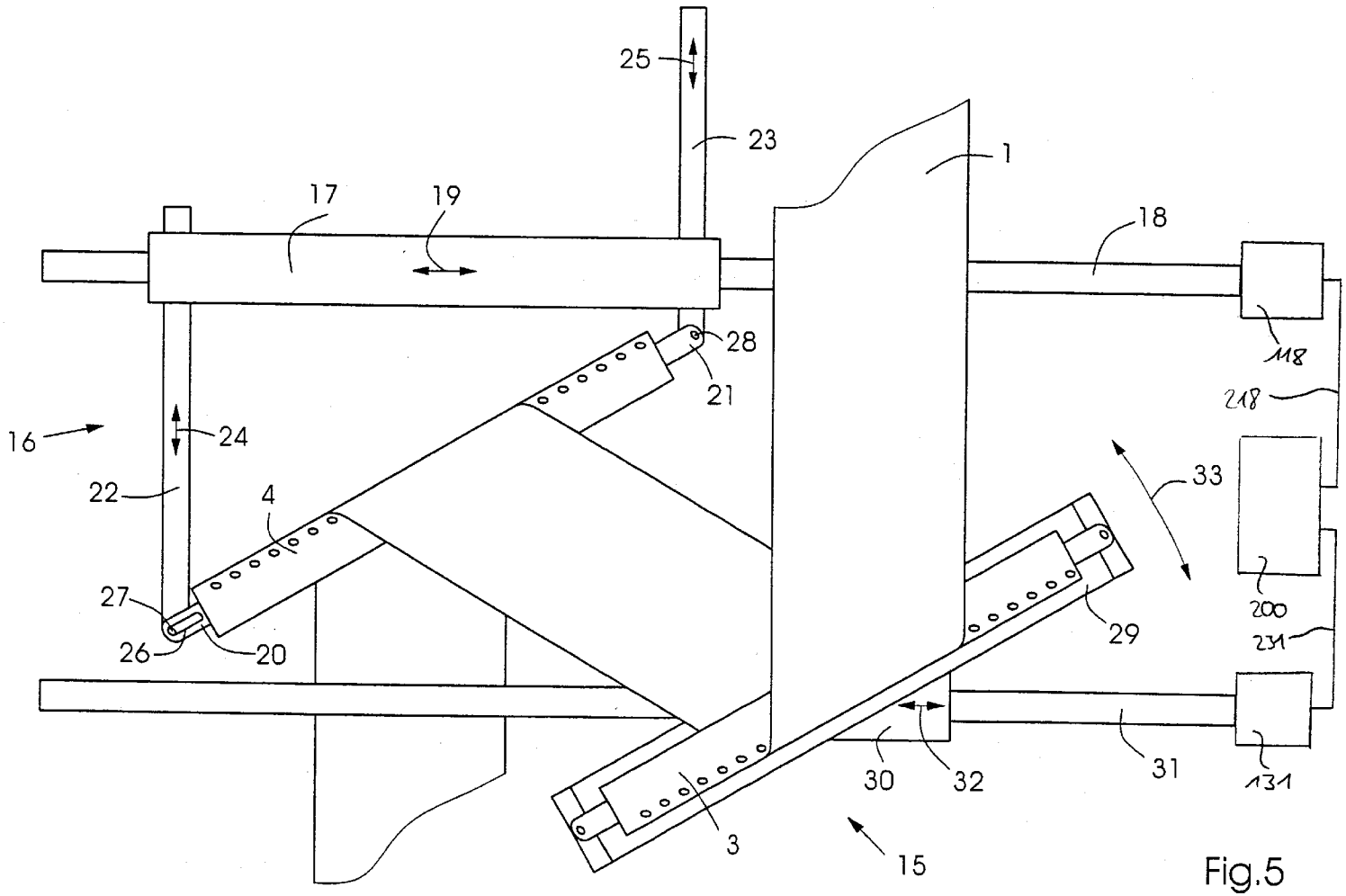
FIG. 5 shows a top view of an embodiment of the device for guiding a travelling web according to the present invention.

FIG. 5 shows an exemplary embodiment of the two angle bars 3, 4 the first movable device 15 and the second movable device 16.

The first movable device 15 comprises a support 29 to which the first angle bar 3 is connected with both ends, which is subsequently pivotably mounted to a first sliding carriage 30 for providing both linear and rotational movements indicated by double arrow 32 and 33. Sliding carriage 30 is mounted movably on a rail element 31.

The second movable device 16 comprises a second sliding carriage 17 which is movably mounted on a second rail element 18 for providing the possibility of a linear movement of second angle bar 4 in a direction indicated by double arrow 19. The two ends 20 and 21 of the movable angle bar 4 are connected to movable pistons 22 and 23 which pistons are slidably mounted in the sliding carriage 17 providing the possibility of a curved or linear movement and a rotational movement of the angle bar 4 indicated by double arrows 24 and 25. The end 20 of the movable angle bar 4 is provided with an elongated hole 26 to compensate the change of the distance between the two connecting points 27 and 28 effected by the linear movement of the pistons 22 and 23. It is also possible to use other compensating means than the elongated hole 26, for example a telescopic arm.

FIG. 5 does not show the connecting pivot point between support 29 and sliding carriage 30 but double arrow 33 indicates the possible rotational movement of the first angle bar 3.

The linear movement of the sliding carriage 30 on rail element 31 and the linear movement 19 of the sliding carriage 17 on rail element 18 can also be used for low value corrections of the lateral position of the entering and the exiting portion of web 1.

The sliding carriages 17, 30, the pivotable support 29 and the pistons 22, 23 define movable device being operative for moving the angle bars 3, 4. The sliding carriages 17, 30 can be driven by driving devices 118, 131 respectively for driving the movement of the respective movable device of at least one of the movable angle bars. The driving devices 118, 131 can be operatively connected to the rail elements 18, 31 respectively, e.g. the rail elements 18, 31 can be threaded rods and the driving devices 118, 131 can be motors for turning the threaded rods. In that case the sliding carriages 17, 30 can be provided with threaded holes, which fit to the threaded rods and allow the movement of the sliding carriages 17, 30 when the threaded rods are being turned. Similar driving devices can be used for driving the pistons 22, 23.

The movement of the movable devices, e.g. the sliding carriages 17, 30 can be controlled by a control device 200, which can be operatively connected to the movable devices (not shown in FIG. 5) or e.g. to the driving devices 118, 131. Control signals for the movements can be provided from the control device 200 via signal or data lines 218, 231 to the respective driving devices 118, 131.

Figure 6:
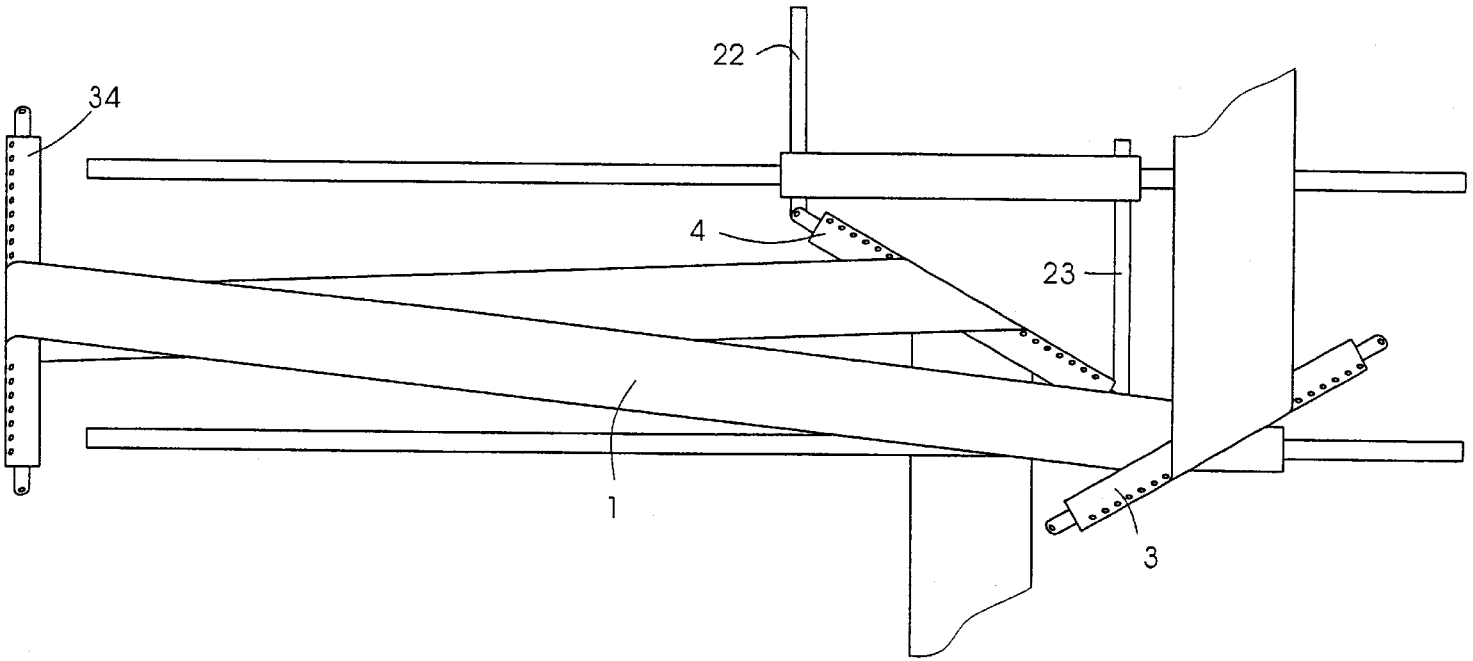
FIG. 6 shows a top view of the embodiment according to FIG. 5 with an additional third bar according to the present invention.

FIG. 6 shows that it is also possible to use the device for guiding a travelling web according to the present invention if the exiting portion of the web 1 has to be turned with respect to the entering portion of the web 1. In that case an additional third bar or turning bar 34 is located between the first angle bar 3 and the second angle bar 4 on the path of the travelling web 1. The two pistons 22 and 23 in this case can be used to rotate the movable angle bar 4 by approximately 90° so that it is no longer oriented parallel to the second movable angle bar 4, but substantially perpendicular to it, as shown.

The angle bar unit shown in FIG. 6 can also comprise a fourth bar located above or below the third bar 34 which allows for sending the travelling web from the angle bar 3 in a first horizontal plane by the use of the third and the fourth bar to the angle bar 4 in a second horizontal plane which can be located above or below the horizontal plane of the angle bar 3. This arrangement is also called a bay-window arrangement.

Figure 7:
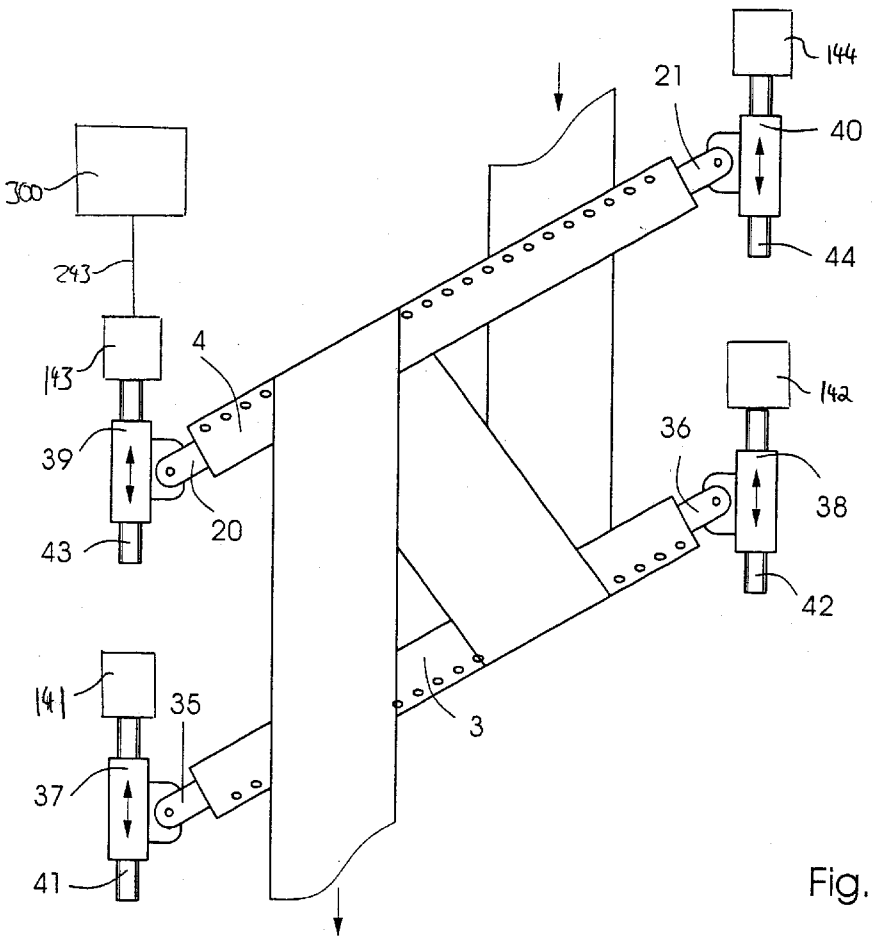
FIG. 7 shows another embodiment of the device for guiding a travelling web in the first operative mode according to the present invention.

FIG. 7 shows a further preferred embodiment of the device for guiding a travelling web with a first movable angle bar 3 and a second movable angle bar 4. The two angle bars 3, 4 are mounted with their respective ends 20, 21, 35 and 36 to respective movable devices 37, 38, 39 and 40 which are movably mounted on respective rail elements 41, 42, 43 and 44, for example threaded rods. The threaded rods 41, 42, 43 and 44 can turned by respective driving devices 141, 142, 143 and 144 which can be controlled by a control device 300. An exemplary signal or data line 243 for providing the control signals is shown only for driving device 143.

Figure 8:
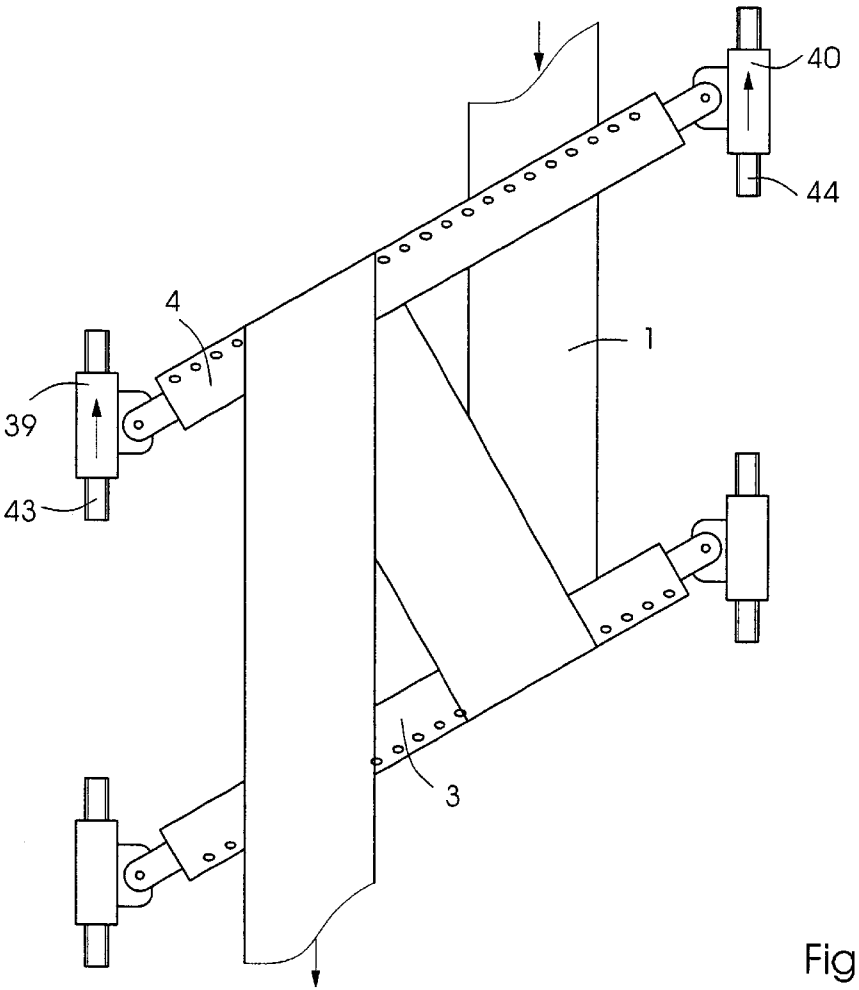
FIG. 8 shows the location of the angle bars in an embodiment according to FIG. 7 in the third operative mode according to the present invention.

FIG. 8 shows how this specific embodiment can be used for a registration shift. The two movable devices 39 and 40 are moved, for example by rotating the threaded rods 43 and 44 in a defined direction so that the distance between the two angle bars is increased and the length of the web path is also increased. This action results in a change or an adjustment of the print-to-cut registration.

Instead of moving the angle bar 4 it is also possible to keep the angle bar 4 in place and move the angle bar 3 for a desired change in the registration setting. Moreover, it is also possible to move both angle bars 3, 4 in opposite directions and distribute the necessary linear movement for the registration change to both angle bars 3, 4.

It may be necessary to superpose this linear movement with a rotational movement in order to adjust the alignment of the respective angle bar with respect to little orientation changes of the other angle bar.

Figure 9:
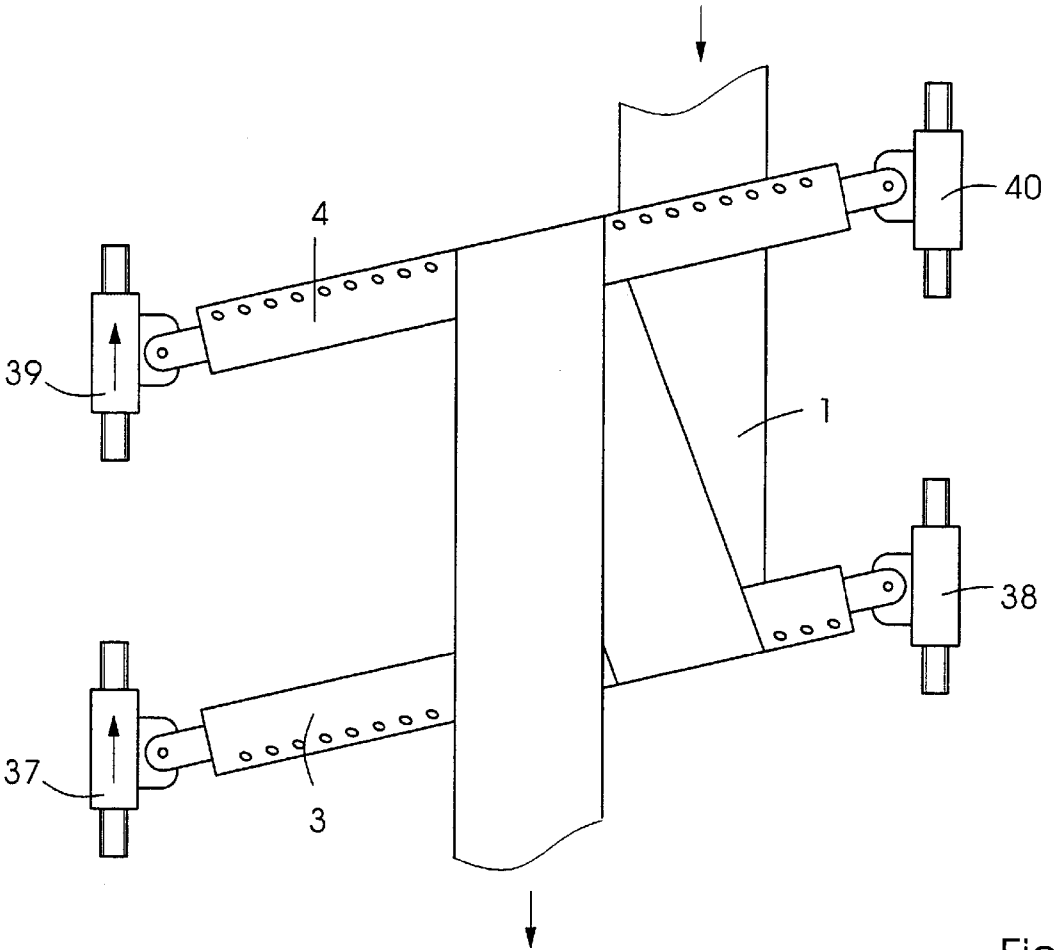
FIG. 9 shows the location of the angle bars in an embodiment according to FIG. 7 in the second operative mode according to the present invention.

FIG. 9 shows the device according to FIGS. 7 and 8 in another operative mode. The two movable devices 40 and 38 are kept in place while the two movable devices 39 and 37 are moved in the same direction with the result that a side shift of the exiting portion of web 1 is achieved. The two angle bars 3, 4 are always parallel to each other. In order to maintain the print-to-cut registration setting a superposed linear movement of one or both of the two angle bars 3, 4 by moving the respective movable devices 39, 40 or 37, 38 simultaneously may be necessary.

Figure 10A:
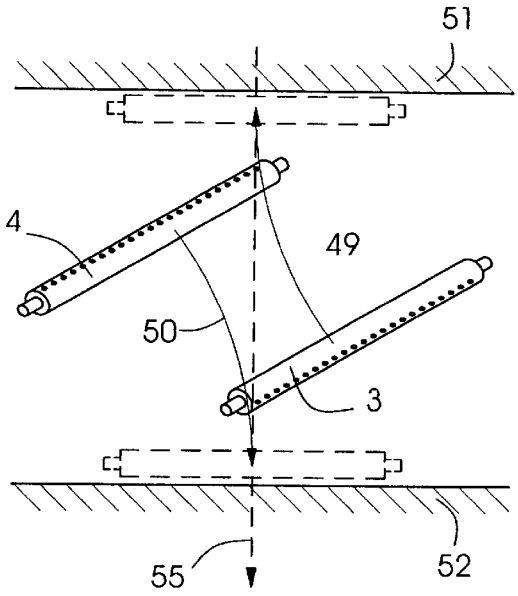
FIGS. 10*a, b* show a schematic diagram of different locations of the first and second movable angle bars in the parking operative mode according to the present invention
Figure 10B:
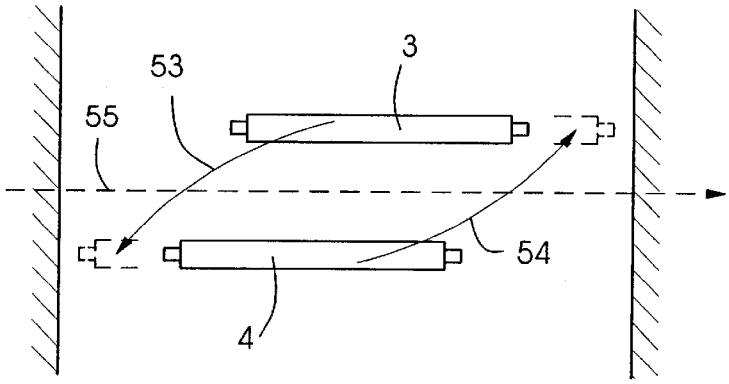

FIGS. 10*a* and 10*b* show a device for guiding a travelling web in the web-up operative mode. In FIG. 10*a* the angle bars 3, 4 are shown in top view without a paper web wrapped around them and the arrows 49 and 50 indicate the movement of the angle bars 3, 4 from the guiding positions to the web-up positions near side frames or beams of the angle bar superstructure 51, 52. It can be seen in the side view of FIG. 10*b* that the angle bars 3, 4 are not only moved in a plane as indicated by arrows 49, 50, but also are moved upward and downward as indicated by arrows 53, 54 to arrive in their respective web-up position. Dashed arrow 55 in FIGS. 10*a* and 10*b* indicates the way of the paper web in the web-up operative mode when the two movable angle bars 3, 4 are located in their respective web-up position. It is also possible to move the angle bars 3, 4 in the web-up mode into their respective parking positions, which are equal to the positions shown in FIG. 2*d*.

The parked angle bars 3, 4 also allow easy access for printers or mechanics.

The respective ends of the two movable angle bars 3, 4 can also be moved into their respective positions for guiding the travelling web by the use of one or more pneumatic cylinders respectively. There can also be provided a respective support for each end of the movable angle bars, so that the ends are moved in a defined plane, preferably but not necessarily a horizontal plane, when the angle bars are moved by actuating the pneumatic cylinders.

The terms first, second, third, fourth, fifth, etc. as used herein are used solely to distinguish various positions and bars from each other. As used in the claims, for example, the term "fourth position" thus does not require that three other positions be present, but merely that the fourth position is different from any other position recited in that specific claim.

What is claimed is:

1. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for switching the first and second movable angle bars between the first, second and third operative modes, the first movable angle bar being movable perpendicular to the entering direction D1 and being pivotable by the control device; and a first movable device, the first movable angle bar being pivotably mounted at both ends to the first movable device.

2. The device as recited in claim 1, further comprising at least one second movable device being operative for moving the second movable angle bar.

3. The device as recited in claim 2, wherein the first movable device is a sliding carriage.

4. The device as recited in claim 1, wherein the second movable angle bar is pivotable.

5. The device as recited in claim 4, further comprising a sliding carriage, and wherein the second movable angle bar is supported by means of pistons, which are slidably supported by the sliding carriage.

6. The device as recited in claim 1, further comprising at least one further guiding element located between the first movable angle bar and the second movable angle bar on the path of the travelling web, the further guiding element guiding the web from the first movable angle bar to the second movable angle bar thereby turning the web.

7. The device as recited in claim 6, wherein the further guiding element is movable.

8. The device as recited in claim 1, wherein the control device controls an automatic movement of at least one of the first and second movable angle bars in at least one of the second and third operative modes.

9. The device as recited in claim 8, further comprising at least one driving device for driving the movement of the respective movable device of at least one of the movable angle bars, the at least one driving device being controlled by the control device.

10. The device as recited in claim 9, wherein the at least one driving device is an electric motor.

11. The device as recited in claim 9, wherein the at least one driving device is a stepping motor.

12. The device as recited in claim 1, wherein at least one of the first and second movable angle bars is an air loaded angle bar.

13. The device as recited in claim 1, wherein at least one of the first and second movable angle bars is provided with a friction-reducing surface.

14. The device as recited in claim 1, wherein at least one of the exiting directions D2 and D3 is parallel to the entering direction.

15. The device as recited in claim 1, wherein the first movable angle bar is located in a position P7 and the second movable angle bar is located in a position P8 in a fourth operative mode to guide the travelling web from the entering direction D1 to an exiting direction D4, the exiting direction D4 being offset with respect to the exiting direction D2, the fourth operative mode having a third print-to-cut registration setting.

16. The device as recited in claim 1, wherein the first movable angle bar is located in a position P9 and the second movable angle bar is located in a position P10 in a parking operative mode to park the first and second movable angle bars.

17. The device as recited in claim 1, wherein the first movable angle bar is located in a position P11 and the second movable angle bar is located in a position P12 in a web up operative mode to thread a web through the device.

18. The device as recited in claim 1, wherein the first movable angle bar is located in a position P13 in a fifth operative mode to accommodate the entering direction D1 of the travelling web.

19. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes, wherein the control device calculates the automatic movement as a function of the entering direction D1, the exiting direction D2, the exiting direction D3 and the first print-to-cut registration setting; the first movable angle bar being movable perpendicular to the entering direction D1 and being pivotable by the control device.

20. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes,wherein the control device calculates the automatic movement as a function of the entering direction D1, the exiting direction D2, the first print-to-cut registration setting and the second print-to-cut registration setting; the first movable angle bar being movable perpendicular to the entering direction D1 and being pivotable by the control device.

21. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes, wherein the control device calculates the automatic movement as a function of a distance between a first reference point of the path of the travelling web located upstream of the first movable angle bar and a second reference point of the path of the travelling web located downstream of the second movable angle bar; the first movable angle bar being movable perpendicular to the entering direction D1 and being pivotable by the control device.

22. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P7 and the second movable angle bar being located in a position P8 in a fourth operative mode to guide the travelling web from the entering direction D1 to an exiting direction D4, the exiting direction D4 being offset with respect to the exiting direction D2, the fourth operative mode having a selected third print-to-cut registration setting; a first movable device, the first movable angle bar being pivotably mounted at both ends to the first movable device; and a control device for switching between the first operative mode and the fourth operative mode; the first movable angle bar being movable perpendicular to entering direction D1 and being pivotable by the control device.

23. The device as recited in claim 22, wherein the first movable angle bar is located in a position P9 and the second movable angle bar is located in a position P10 in a parking operative mode to park the first and second movable angle bars.

24. The device as recited in claim 22, wherein the first movable angle bar is located in a position P11 and the second movable angle bar is located in a position P12 in a web up operative mode to thread a web through the device.

25. The device as recited in claim 22, wherein the first movable angle bar is located in a position P13 in a fifth operative mode to accommodate the entering direction D1 of the travelling web.

26. A method for guiding a travelling web, comprising the following steps:

locating a first movable angle bar in a position P1, locating a second movable angle bar in a position P2, guiding the travelling web from an entering direction D1 to an exiting direction D2 and defining a first print-to-cut registration setting;

moving the first movable angle bar into a position P3, moving the second movable angle bar into a position P4, thereby maintaining the first print-to-cut registration setting, and guiding the travelling web from the entering direction D1 to an exiting direction D3, the exiting direction D3 being offset with respect to the exiting direction D2; and moving the first movable angle bar into a position P5, moving the second movable angle bar into a position P6, thereby maintaining the exiting direction D2 and changing to a second print-to-cut registration setting.

27. A method for guiding a travelling web, comprising the following steps:

locating a first movable angle bar in a position P1, locating a second movable angle bar in a position P2, guiding the travelling web from an entering direction D1 to an exiting direction D2 and defining a first print-to-cut registration setting;

moving the first movable angle bar into a position P7, moving the second movable angle bar into a position P8, and selecting a second print-to-cut registration setting, and guiding the travelling web from the entering direction D1 to an exiting direction D4, the exiting direction D4 being offset to the exiting direction D2.

28. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting;

a control device for switching the first and second movable angle bars between the first, second and third operative modes, the first movable angle bar being movable perpendicular to the entering direction D1 and being pivotable by the control device, the second movable angle bar being pivotable; and a sliding carriage, the second movable angle bar being supported by means of pistons slidably supported by the sliding carriage.

29. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes, wherein the control device reloads stored calculated values to control the automatic movement, the values being a function of the entering direction D1, the exiting direction D2, the exiting direction D3 and the first print-to-cut registration setting; the first movable angle bar being movable perpendicular to the entering direction D1 and being pivotable by the control device.

30. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes, wherein the control device reloads stored calculated values to control the automatic movement, the values being a function of the entering direction D1, the exiting direction D2, the first print-to-cut registration setting and the second print-to-cut registration setting; the first movable angle bar being movable perpendicular to the entering direction D1 and being pivotable by the control device.

31. A device for guiding a travelling web, comprising:

a first movable angle bar and a second movable angle bar;

the first movable angle bar being located in a position P1 and the second movable angle bar being located in a position P2 in a first operative mode to guide the travelling web from an entering direction D1 to an exiting direction D2 and to define a first print-to-cut registration setting;

the first movable angle bar being located in a position P3 and the second movable angle bar being located in a position P4 in a second operative mode to guide the travelling web from the entering direction D1 to an exiting direction D3, the exiting direction D3 being offset with respect to the exiting direction D2, the second operative mode having the first print-to-cut registration setting;

the first movable angle bar being located in a position P5 and the second movable angle bar being located in a position P6 in a third operative mode to guide the travelling web from the entering direction D1 to the exiting direction D2, the third operative mode having a second print-to-cut registration setting; and a control device for controlling an automatic movement of at least one of the first and second movable angle bars in at least one of the second and third operative modes, wherein the control device reloads stored calculated values to control the automatic movement, the values being a function of a distance between a first reference point of the path of the travelling web located upstream of the first movable angle bar and a second reference point of the path of the travelling web located downstream of the second movable angle bar; the first movable angle bar being movable perpendicular to the entering direction D1 and being pivotable by the control device.

* * * * *